United States Patent [19]

Miller

[11] Patent Number: 4,772,178

[45] Date of Patent: Sep. 20, 1988

[54] THERMAL SHIELD FOR THE STEAM INLET CONNECTION OF A STEAM TURBINE

[75] Inventor: Lewis J. Miller, Winter Springs, Fla.

[73] Assignee: Westinghouse Electric Corp., Pittsburgh, Pa.

[21] Appl. No.: 8,029

[22] Filed: Jan. 28, 1987

[51] Int. Cl.[4] ..... F01D 25/12

[52] U.S. Cl. ..... 415/177; 415/135; 415/136; 415/178

[58] Field of Search ..... 415/134, 135, 136, 177, 415/178, 183

[56] References Cited

U.S. PATENT DOCUMENTS

| | | | |
|---|---|---|---|
| 2,808,226 | 10/1957 | Hacker et al. | 415/135 |
| 2,879,029 | 3/1959 | Wienola | 415/135 |
| 3,746,463 | 7/1973 | Stock et al. | 415/136 |
| 4,460,313 | 7/1984 | Austrem | 415/177 |

*Primary Examiner*—Larry I. Schwartz

[57] ABSTRACT

Apparatus and method for reducing thermal stress in the casings of a steam turbine. A novel inlet sleeve carries high pressure steam from the bell connector of an inlet pipe through the turbine inner casing. The inlet sleeve is connected at a first end to the bell connector and secured at a mid portion to the inner casing so that the second end of the inlet sleeve may terminate adjacent the inner casing wall without contacting the inner casing. This connection means forms a cylindrical chamber having a closed end at the mid portion of the inlet sleeve and an open end adjacent the inner wall of the turbine inner casing. The cylindrical chamber provides a thermal shield which isolates portions of the turbine inner casing adjacent the inlet sleeve from the rapid steam flow between the inlet pipe and the turbine blading.

6 Claims, 3 Drawing Sheets

THERMAL SHIELD FOR THE STEAM INLET CONNECTION OF A STEAM TURBINE

This invention relates in general to steam turbines of the type used in electric power generating systems and in particular to an apparatus and method for reducing thermal stress in the casings of a steam turbine.

BACKGROUND OF THE INVENTION

The high temperatures prevalent in modern steam turbines have led to numerous design problems. One of these problems, excessive thermal stress, has stimulated a number of design changes in order to minimize the effects of large temperature gradients across structural walls as well as to minimize differential expansion between various turbine components. Generally, high pressure and intermediate pressure fossil turbines are constructed with concentric inner and outer casings which are cylindrical in shape and which have as high a degree of radial symmetry as possible in order to reduce thermal stresses. The inner casing, which is free to expand radially, supports the high temperature blade ring in the high pressure blade path. The inner casing also serves as a pressure vessel thus permitting a relatively thin outer casing. After expansion across the turbine blading the lower temperature steam flows through the chamber formed between the inner and outer casings in order to reduce the temperature differential across the inner casing walls to moderate values. While these improvements have both reduced the magnitude of temperature gradients and the fluctuations in temperature gradients across structural walls, the double casing design presents additional problems of thermal stress.

Specifically, turbine inlet pipes, which carry high temperature steam through the outer casing and the inner casing to the blade rings of a turbine, are another source of thermal stress and can result in fracturing around the joints between the piping and the turbine casings. Under steady state conditions, a stable temperature gradient forms across the inner casing wall as one side of the wall if subjected to a relatively constant high temperature steam flow while the other side of the wall is subjected to a similar, but lower temperature, steam flow. This is illustrated by curve A in FIG. 1 wherein the temperature variation between the inside and outside walls of an inner casing is qualitatively described. However, when the incoming steam flow rate rises in response to an increased demand for power, the rate of heat transfer to the inside wall of the inner casing increases and the temperature gradient across the inner casing shifts as illustrated qualitatively by curve B in FIG. 1. This thermal shift results in differential expansion about the joints between the inlet piping and the turbine casings. Limited efforts have been made in the past to shield turbine casings as well as other stationary turbine elements from direct steam flows which are most responsible for inducing these thermal stresses. By way of example, with reference to FIG. 2, there is illustrated the provision of a shielding element 4 disposed about the inside surface of inner casing 6 of a turbine 9. This shielding is spaced a small distance from the casing wall in order to provide an annular gap which shields the casing from the high rates of heat transfer which would otherwise result from the rapid flow of steam through the turbine.

A different approach has been taken in the past in order to reduce thermal stress in the connection between the inlet pipe 12 and the outer casing wall 8. Pipe 12 terminates in a flexible bell connector 16 which is a tube-like member having three connections. A first weld connection joins pipe 12 to a first end 18 of connector 16. The connector 16 comprises an annular flange 20 which is secured to the outer casing 8 by a second weld connection. The second end 22 of connector 16 forms a tight but flexible connection with an inlet sleeve 28. Pressure seal rings 24 assure that high temperature steam does not escape the flexible connection joint and enter into chamber 32 as steam flows through the inlet sleeve 28 and into inner casing 6. As pipe 12 expands under conditions of increased steam flow the second end 22 of connector 16 may freely expand without stressing either the connection of flange 20 to the outer casing or the flexible seal ring connection between connector 16 and sleeve 28.

In the past, the provision of thermal shielding about casing walls and the use of flexible bell connectors as described above have provided some relief from the heat stress problems which occur in turbine casings. These design techniques however, have not been suitable for reducing thermal stresses at the connection 40 between the inlet sleeve 28 and the inner casing 6. For example, the extension of shielding 4 to fully line the inside of inlet sleeve 28 creates undesirable flow disturbances and is to be avoided. Even a limited extension of shielding 4 in the inlet sleeve as illustrated in FIG. 2 creates an undesirable flow disturbance at end point 38 of the shielding. Consequently, a solution has not heretofore been available for reducing heat stresses across the connection joining the inlet sleeve 28 and the inner casing 6.

SUMMARY OF THE INVENTION

Among the several objects of the present invention may be noted the provision of an improved inlet sleeve for carrying high temperature steam from an inlet pipe through the inner and outer casings to the blade rings in a steam turbine and a method for reducing thermal stresses along the connection between a steam inlet pipe and the blade rings of a turbine which overcome the above discussed disadvantages or undesirable features as well as others, of the prior art; the provisions of such improved inlet sleeve including the shielding of the turbine inner casing at the connection of the inlet sleeve with the inner casing; the provision of such an improved inlet sleeve and method for reducing thermal stresses in steam connections between the inlet pipe and blade rings of a turbine which utilize a tube-like sleeve, connected at a first end to the bell connector of an inlet pipe and secured at a mid position to the turbine inner casing so that a second end of the tube extends through an inlet port leading to the nozzle chamber.

In general, there is provided an improved inlet sleeve which eliminates thermal stresss on the turbine casings which would otherwise be created under increased steam flow rates. The improved inlet sleeve isolates steam which flows between the inlet pipe and the blade rings of a turbine from the turbine inner and outer casings in order to reduce the rates of heat transfer to the turbine casings.

Further in general, there is provided a method for reducing thermal stress along the connection between a steam inlet pipe and the inner casing of a steam turbine wherein the turbine comprises an outer casing disposed about an inner casing, at least one inlet port providing fluid communication between the inlet pipe and the blade rings and a bell connector which is welded at a first end to the inlet pipe, connected to the outer casing by an annular flange and adapted at a second end for flexible connection to the inlet sleeve. The method comprises the steps of connecting a first end of the inlet sleeve to the second end of the bell connector and securing a mid portion of the inlet sleeve to the turbine inner casing so that a second end of the inlet sleeve may extend through the inlet port without contacting the inner casing.

DETAILED DESCRIPTION OF THE INVENTION

Figure 3:
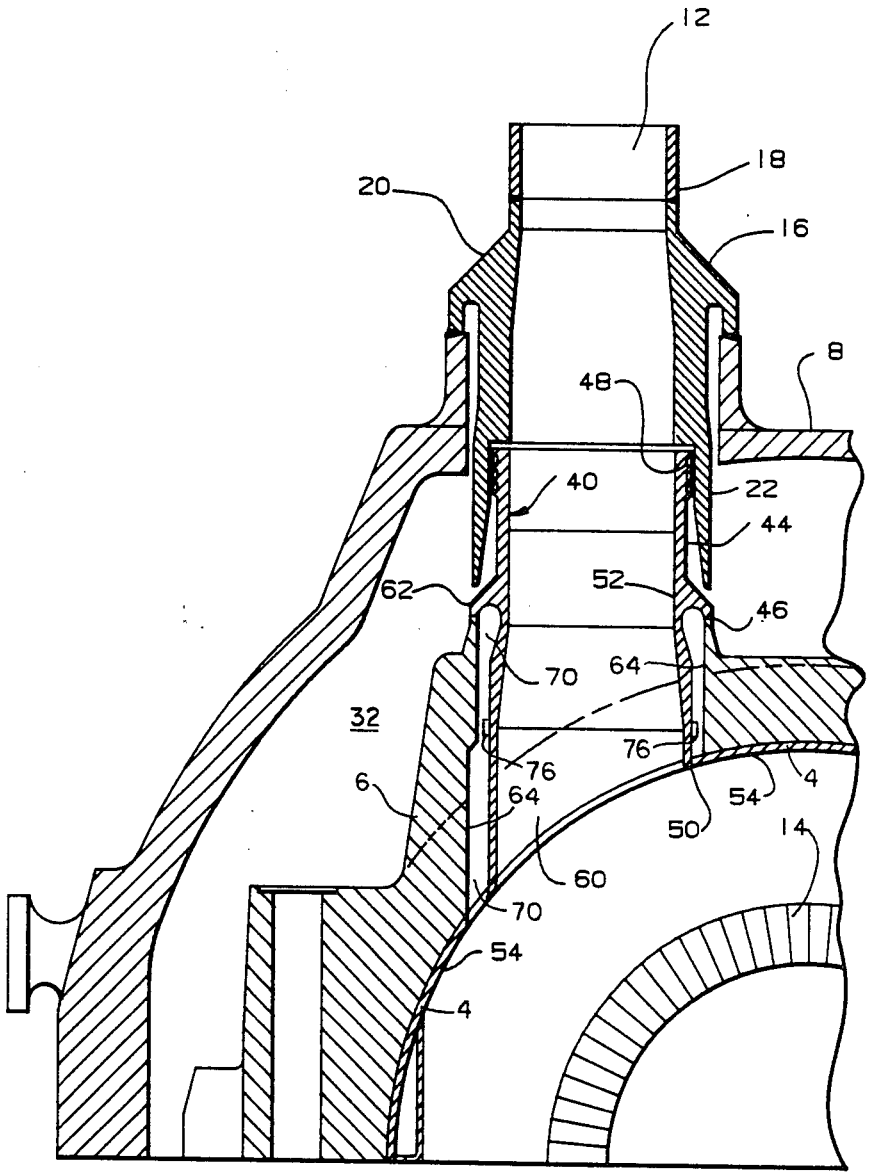
FIG. 3 illustrates a preferred embodiment of the inventive inlet sleeve.

Referring now to FIG. 3, there is illustrated in a preferred embodiment an inventive inlet sleeve 40 suitable for carrying high temperature steam from an inlet pipe 12 to blade ring 14 of a steam turbine 10. It is to be understood that the inventive inlet sleeve and the inventive method are presented by way of example with specific application of shielding the connection between a main steam inlet pipe and an inner casing 6 in a turbine from thermal stress, but that the inventive sleeve and method are suitable most generally for applications where heat stress caused by high temperature fluid flow across and through structural walls is to be avoided.

Figure 2:
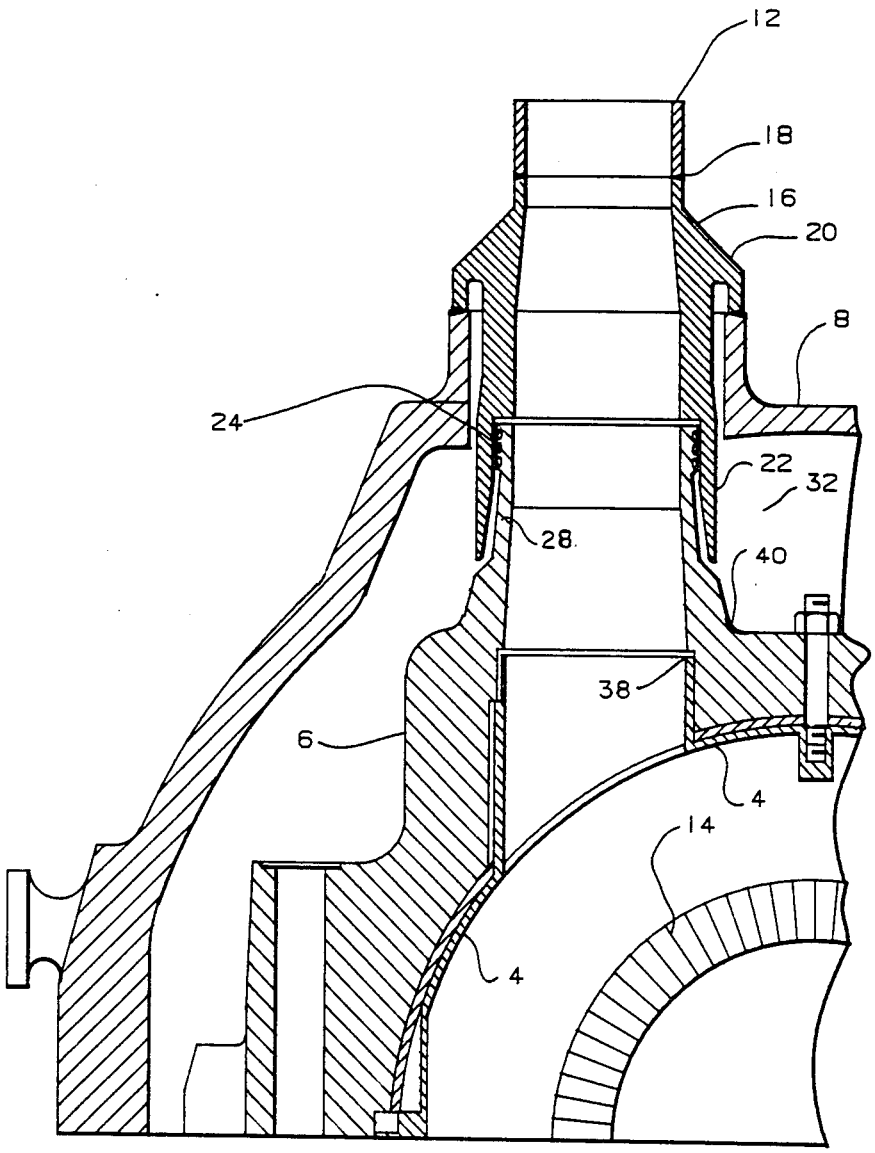
FIG. 2. PRIOR ART
FIG. 2 illustrates a prior art heat shielding arrangement about the inlet sleeve of a steam turbine.

Inlet pipe 12 delivers high temperature steam to bell connector 16 which is welded at a first end 19 to the inlet pipe connected by means of an annular flange 20 to the turbine outer casing 8 and adapted at a second end 22 for flexible connection to the inventive inlet sleeve 40. The inventive inlet sleeve 40 differs from inlet sleeves known in the prior art, such as, for example, inlet sleeve 28 illustrated in FIG. 2 because the inventive inlet sleeve, in conjunction with the bell connector 16, provides a continuous heat shield in order to protect the turbine outer casing 8 and inner casing 6 from thermal stresses as steam flows into the inner casing. Inlet sleeve 40 is a tube-like structure having a first end 48, a second end 50 and a mid portion 52. In the preferred embodiment first end 48 is adaptable for a flexible connection with bell connector 16 in the same manner as discussed above with regard to the connection of inlet sleeve 28 to bell connector 16 in FIG. 2. A plurality of pressure seal rings 24 are interposed between the second end 22 of connector 16 and the first end 48 of inlet sleeve 40. Each seal ring is disposed in an annular groove about first end 48 as is common in the art. However, inlet sleeve 40 is to be distinguished from inlet sleeves known in the prior art because of its unique thermal insulating connection to inner casing 6. At mid portion 52 of inlet sleeve 40, there extends outwardly an annular flange 62 adapted for a weld connection 46 to inner casing 6. It is to be noted that inlet sleeve 40 comprises two isolated connections in order to establish structural integrity and to prevent the seepage of high temperature pressurized fluid into the chamber 32 formed between inner casing 6 and outer casing 8. The second end 50 of inlet sleeve 40 extends through inlet port 60 of inner casing 6 and terminates adjacent inner wall 54 of inner casing 6. The section of inlet sleeve 40, extending from mid portion 52 toward inner wall 54 fits concentrically within inlet port 60 in order to form an annular chamber 70 having an open end adjacent inner wall 54 of inner casing 6 and a closed end at mid portion 52. Chamber 70, although in communication with steam flow, is isolated from direct fluid flow along inlet sleeve 40 thereby providing an insulative gap so that, except for very limited heat flow through flange 62, heat transferred from the high temperature steam to inlet sleeve 40 is isolated from the inlet port wall 64 by chamber 70. The provision of chamber 70 eliminates severe thermal stresses on inner casing 6 which would result from large fluctuations in steam flow rate. Further insulation of inner casing 6 is provided by thermal shield 4 disposed about inner casing wall 54. It is noted that a novel feature of inlet sleeve 40 is that it is not connected to thermal shield 4. Rather, the second end of inlet sleeve 40 is a flexible member which is free to expand and contract without coming into contact with either the inlet port wall 64 or thermal shield 4. As a result of these novel features inlet sleeve 40 is free to expand and contract without inducing thermal stresses which were prevalent in the prior art.

A plurality of alignment lugs 76 may extend outwardly about inlet sleeve 40 in order to assure correct alignment of inlet sleeve 40 about the inlet port wall 64. The lugs may be attached to inlet sleeve 40 through threaded connections so that once alignment is achieved, the lugs may be moved inward in order to reduce heat transfer between inlet sleeve 40 and inner casing 6.

Figure 1:
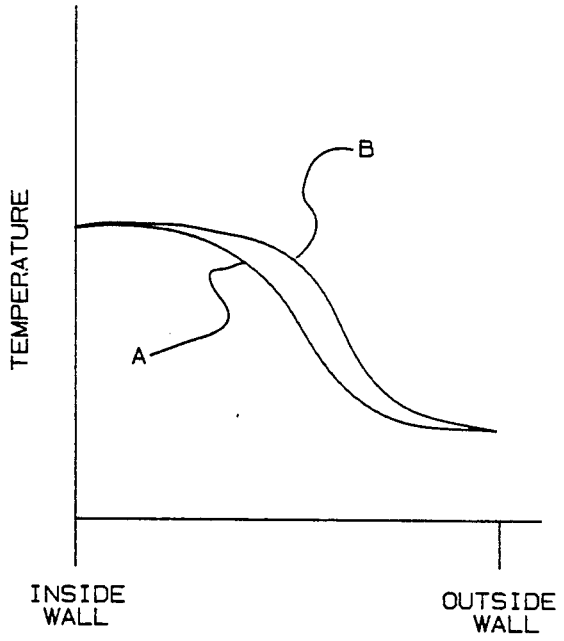
FIG. 1 qualitatively illustrates variations in temperature across the inner casing wall of a turbine under steady state conditions and under conditions of increased steam flow.

In a turbine which incorporates the inventive inlet sleeve 40, when the steam flow rate rises from a steady state condition in response to an increased demand for power, the rate of heat transfer to inner casing 6 will be minimized. As a result the shift in the thermal gradient across the inner casing wall, as illustrated in FIG. 1 will also be minimized and thermal stresses will be reduced.

Generally, the inventive method for reducing thermal stress along the connection between the steam inlet pipe 12 and blade ring 14 comprises the steps of first connecting one end of a tube-like inlet sleeve 40 to the second end 22 of the bell connector 16; then securing a mid portion 52 of the inlet sleeve to inner casing 6 so that a second end of the inlet sleeve may extend through the inlet port 60 without contacting the inner casing 6. This method of reducing the rate of heat transfer to inner casing 6 from the high temperature fluid flowing along inlet sleeve 40 is accomplished by providing an insulating chamber 70. An annular flange 62 may be formed on the outside of inlet sleeve 40 in order to effect a weld connection with inner casing 6. A plurality of seal rings 24 may interpose the connection of inlet sleeve 40 to bell connector 16 in order to assure a pressure tight, flexible connection and seal.

From the foregoing, it is now apparent that a novel inlet sleeve for reducing thermal stress while carrying high temperature steam from an inlet pipe to the blade rings of steam turbine has been presented as well as a novel method for reducing thermal stress along the connection between the steam inlet pipe and inner casing of a steam turbine thus meeting the objects set out hereinbefore as well as others, and it is contemplated that changes as to the precise elements and arrangements thereof, the details and connections of component parts utilized with the inventive inlet sleeve, and the precise steps and order thereof of such method may be made by those having ordinary skill in the art without departing from the scope of the invention as set forth in the claims which follow.

I claim:

1. An inlet sleeve for carrying high temperature steam from an inlet pipe to the blade rings of a steam turbine wherein the turbine comprises an outer casing disposed about an inner casing, at least one inlet port providing fluid communication between the inlet pipe and an inner wall of the inner casing, and a bell connector which is welded at a first end to the inlet pipe, which is connected by means of an annular flange to the outer casing and which is adapted at a second end for flexible connection to said inlet sleeve, said inlet sleeve comprising:

a tube having a first end, a second and a mid portion, the first end being adapted for flexible connection to the bell connector, the second end extending through the inlet port and terminating adjacent the inner wall of the inner casing; and connection means extending from the mid portion of said tube and adapted for securing said tube to the inner casing, the inlet port, the second end of said tube and said connection means forming a cylindrical chamber having an open end adjacent the inner wall of the inner casing and a closed end adjacent said connection means.

2. The inlet sleeve of claim 1 further comprising seal means for providing a pressure tight and flexible connection between the first end of said tube and the bell connector.

3. The inlet sleeve of claim 2 wherein:

(a) said connection means comprises an annular flange extending outward from said tube whereby a weld connection may be formed between said inlet sleeve and the inner casing;

(b) the first end of said tube includes at least one annular groove; and (c) said seal means comprises at least one pressure seal ring disposed about the at least one annular groove in the first end of said tube in order to prevent movement of steam from the bell connector into the chamber.

4. A method for reducing thermal stress along an inlet sleeve connecting a steam inlet pipe with the inner casing of a steam turbine wherein the turbine comprises an outer casing disposed about an inner casing, at least one inlet port providing fluid communication between the inlet pipe and the inner wall of the inner casing and a bell connector which is welded at a first end to the inlet pipe and connected by means of an annular flange to the outer casing and adapted at a second end for flexible connection to the inlet sleeve, the method comprising the steps of:

flexibly connecting a first end of the inlet sleeve to the second end of the bell connector; and securing a mid portion of the inlet sleeve to the inner casing so that the second end of the inlet sleeve extends through the inlet port and terminates adjacent the inner casing wall without contacting the inner casing.

5. The method of claim 4 wherein the mid portion of the inlet sleeve is connected to the inner casing by an annular flange.

6. The method of claim 5 wherein at least one seal ring interposes the connection between the first end of the inlet sleeve and the second end of the bell connector in order to form a flexible and pressure tight seal.

* * * * *